US008139807B2

(12) United States Patent
Reiss et al.

(10) Patent No.: US 8,139,807 B2
(45) Date of Patent: Mar. 20, 2012

(54) HEADSET WITH NOISE PLATES

(75) Inventors: Jordan Reiss, San Francisco, CA (US); Kurt Dammermann, San Francisco, CA (US); Joshua LaTendresse, Emeryville, CA (US); Adam Barry, San Francisco, CA (US); Dana Krieger, Seattle, WA (US); Brett Lovelady, Saratoga, CA (US)

(73) Assignee: Astro Gaming, Inc., San Francisco, CA (US)

( * ) Notice: Subject to any disclaimer, the term of this patent is extended or adjusted under 35 U.S.C. 154(b) by 609 days.

(21) Appl. No.: 12/337,526

(22) Filed: Dec. 17, 2008

(65) Prior Publication Data

US 2009/0238397 A1 Sep. 24, 2009

Related U.S. Application Data

(60) Provisional application No. 61/014,360, filed on Dec. 17, 2007.

(51) Int. Cl.
*H04R 5/033* (2006.01)

(52) U.S. Cl. ..... 381/375; 381/371

(58) Field of Classification Search ..... 381/370, 381/371, 375; 2/423
See application file for complete search history.

(56) References Cited

U.S. PATENT DOCUMENTS

| | | | | |
|---|---|---|---|---|
| 1,127,161 | A | 2/1915 | Baldwin | 381/379 |
| 2,782,423 | A | 2/1957 | Eli et al. | 2/209 |
| 4,270,025 | A | 5/1981 | Alsup et al. | 179/15.55 R |
| 4,302,635 | A * | 11/1981 | Jacobsen et al. | 381/371 |
| 4,472,607 | A * | 9/1984 | Houng | 181/18 |
| 4,554,993 | A | 11/1985 | Houng | 181/130 |
| 4,588,868 | A * | 5/1986 | Bertagna et al. | 381/382 |
| 4,829,571 | A | 5/1989 | Kakiuchi et al. | 381/309 |
| 4,965,836 | A * | 10/1990 | Andre et al. | 381/370 |
| 5,018,599 | A * | 5/1991 | Dohi et al. | 181/129 |
| 5,035,005 | A * | 7/1991 | Hung | 2/209 |
| 5,579,430 | A | 11/1996 | Grill et al. | 395/2.12 |
| 5,685,775 | A | 11/1997 | Bakoglu et al. | 463/41 |
| 5,793,878 | A * | 8/1998 | Chang | 381/370 |
| 6,016,347 | A | 1/2000 | Magnasco et al. | 379/430 |
| 6,069,964 | A | 5/2000 | Yang | |
| 6,097,809 | A * | 8/2000 | Lucey et al. | 379/430 |
| 6,183,367 | B1 | 2/2001 | Kaji et al. | 463/42 |

(Continued)

FOREIGN PATENT DOCUMENTS

EP 1 638 364 A2 3/2006

(Continued)

OTHER PUBLICATIONS

Fibush, David K., "Integrating Digital Audio Into the Serial Digital Video Signal," SMPTE Journal, pp. 574-579, Sep. 1994.

(Continued)

*Primary Examiner* — Jeremy Luks
(74) *Attorney, Agent, or Firm* — Dawn-Marie Bey; King & Spalding LLP

(57) ABSTRACT

A headset comprises two earphones joined together by a band which can be worn over the head of a wearer. Each earphone includes a noise plate, which functions to attenuate or eliminate noise from the environment such as a tournament gaming environment. The noise plate includes an aperture through which a boom assembly that houses a microphone may engage to transmit utterances of the wearer to audio processing circuitry. A grille can be exposed when the noise plate is removed, which allows sounds produced in the ambient environment to enter the earphone.

16 Claims, 8 Drawing Sheets

U.S. PATENT DOCUMENTS

| | | | | |
|---|---|---|---|---|
| 6,241,612 | B1 | 6/2001 | Heredia | 463/42 |
| 6,295,366 | B1 * | 9/2001 | Haller et al. | 381/374 |
| 6,466,681 | B1 * | 10/2002 | Siska et al. | 381/372 |
| 6,599,194 | B1 | 7/2003 | Smith et al. | 463/30 |
| 6,618,714 | B1 | 9/2003 | Abrahams | 706/45 |
| 6,658,130 | B2 * | 12/2003 | Huang | 381/384 |
| 6,731,771 | B2 * | 5/2004 | Cottrell | 381/371 |
| 6,775,390 | B1 * | 8/2004 | Schmidt et al. | 381/371 |
| 6,868,164 | B2 * | 3/2005 | Ito et al. | 381/370 |
| 7,082,393 | B2 * | 7/2006 | Lahr | 704/233 |
| 7,090,582 | B2 | 8/2006 | Danieli et al. | 463/35 |
| 7,181,037 | B2 * | 2/2007 | Birch | 381/375 |
| 7,371,175 | B2 | 5/2008 | Gilboy et al. | 463/35 |
| 7,458,894 | B2 | 12/2008 | Danieli et al. | 463/42 |
| 2002/0110246 | A1 | 8/2002 | Gosior et al. | 381/2 |
| 2002/0131616 | A1 * | 9/2002 | Bronnikov et al. | 381/370 |
| 2002/0196960 | A1 * | 12/2002 | Pham et al. | 381/375 |
| 2004/0132509 | A1 * | 7/2004 | Glezerman | 455/575.2 |
| 2004/0213427 | A1 * | 10/2004 | Yoon | 381/370 |
| 2005/0003892 | A1 | 1/2005 | Cheng et al. | 463/35 |
| 2005/0007500 | A1 | 1/2005 | Lin et al. | 348/790 |
| 2005/0181872 | A1 | 8/2005 | Acharya et al. | 463/35 |
| 2006/0062417 | A1 * | 3/2006 | Tachikawa | 381/378 |
| 2006/0256992 | A1 * | 11/2006 | Liao | 381/371 |
| 2007/0064969 | A1 * | 3/2007 | Chou | 381/381 |
| 2007/0093279 | A1 * | 4/2007 | Janik | 455/569.1 |
| 2007/0183616 | A1 * | 8/2007 | Wahl et al. | 381/370 |
| 2007/0261153 | A1 * | 11/2007 | Wise et al. | 2/423 |
| 2008/0152160 | A1 | 6/2008 | Chew et al. | 381/71.6 |
| 2008/0311986 | A1 | 12/2008 | Reisss et al. | 463/35 |
| 2009/0252355 | A1 | 10/2009 | Mao | 381/309 |

FOREIGN PATENT DOCUMENTS

| | | | |
|---|---|---|---|
| WO | 03/103255 | A1 | 12/2003 |

OTHER PUBLICATIONS

Press Release, "Xbox Turns Up the Volume on the Future of Video Games" [online], May 20, 2001 [retrieved on Apr. 8, 2010], 2 pp., Retrieved From the Internet: http://www.microsoft.com/presspass/2002/may02/05-20e3brie . . . .

Turtle Beach, "New Gaming Headphones Provide Amplification of Game Audio and Xbox Live Chart" [online], Oct. 8, 2006 [retrieved on Apr. 8, 2010], 1 p., Retrieved From the Internet: http://www.turtlebeach.com/releases/20061008/Ear-Force-X1-Xbo . . . .

Turtle Beach, "First Wireless Headphone for Xbox 360 with Independent Volume Control of Amplified Chat and Game Audio" [online], Aug. 22, 2007 [retrieved on Apr. 8, 2010], 2 pp., Retrieved From the Internet: http://www.turtlebeach.com/releases/20070822/Turtle-Beach-Annou . . . .

International Search Report and Written Opinion for Application No. PCT/US2010/058629, dated Jan. 28, 2011, 8 pp.

"Zehn Kopfhörer-Mikrofon-Sets im Vergleich," Computer Bild, Oct. 17, 2007, <http://www.computerbild.de/artikel/cbs-Tests-Hardware-Zehn-Kopfhoerer-Mikrofon-Sets-im-Vergleich-1873070.html> [retrieved Mar. 2, 2009], pp. 2-12.

International Search Report dated Jul. 15, 2009, issued in corresponding PCT/US2008/087280, filed Dec. 17, 2008.

* cited by examiner

HEADSET WITH NOISE PLATES

CROSS-REFERENCE TO RELATED APPLICATION

This application claims the benefit of Provisional Application No. 61/014,360, filed Dec. 17, 2007, which is incorporated herein by reference.

BACKGROUND

Conventional headphones are formed from two loudspeakers, shrunken in size, which are assembled together by a headband and worn over the ears of the wearer. Heavy and large in the past, headphones today feature modern designs that are lighter and smaller. In noisy environments, such as game tournaments, the use of headphones is necessary for team members to hear game sounds. To relay strategies, team members often have to shout loudly so that they can hear each other.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

One aspect of the present subject matter includes a headset that comprises a left earphone configured to convert electrical energy into sound waves. The left earphone includes a left noise plate. The left noise plate includes a left aperture configured to guide a microphone to make contact with the left earphone. The headset also includes a right earphone configured to convert electrical energy into sound waves. The right earphone includes a right noise plate. The right noise plate includes a right aperture configured to guide the microphone to make contact with the right earphone. The headset further includes a band configured to hold the left earphone and the right earphone so as to allow the headset to be worn over the head of a wearer.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

In competitive gaming environments, modern headsets are connected to an audio exchange with boom assemblies that support microphones, easing communications among teammates without the need to shout to be heard. In various embodiments of the present subject matter, earphones, which convert electrical energy into sound waves, are designed with a grille, which is configured as a permeable layer to receive sounds produced externally in the gaming environment, in combination with a noise plate, which is configured to attenuate or eliminate noise, when the noise plate covers the grille. The visibility of the noise plate also provides a platform on which art work, advertisements, insignia, trademarks, designs, and so on, are displayed. Each noise plate also has an aperture that guides a jack of a boom assembly into internal audio components to receive communications uttered by a wearer. The boom assembly can be removably detached and attached to either the right earphone or the left earphone, depending on the preference of the wearer.

Figure 1A:
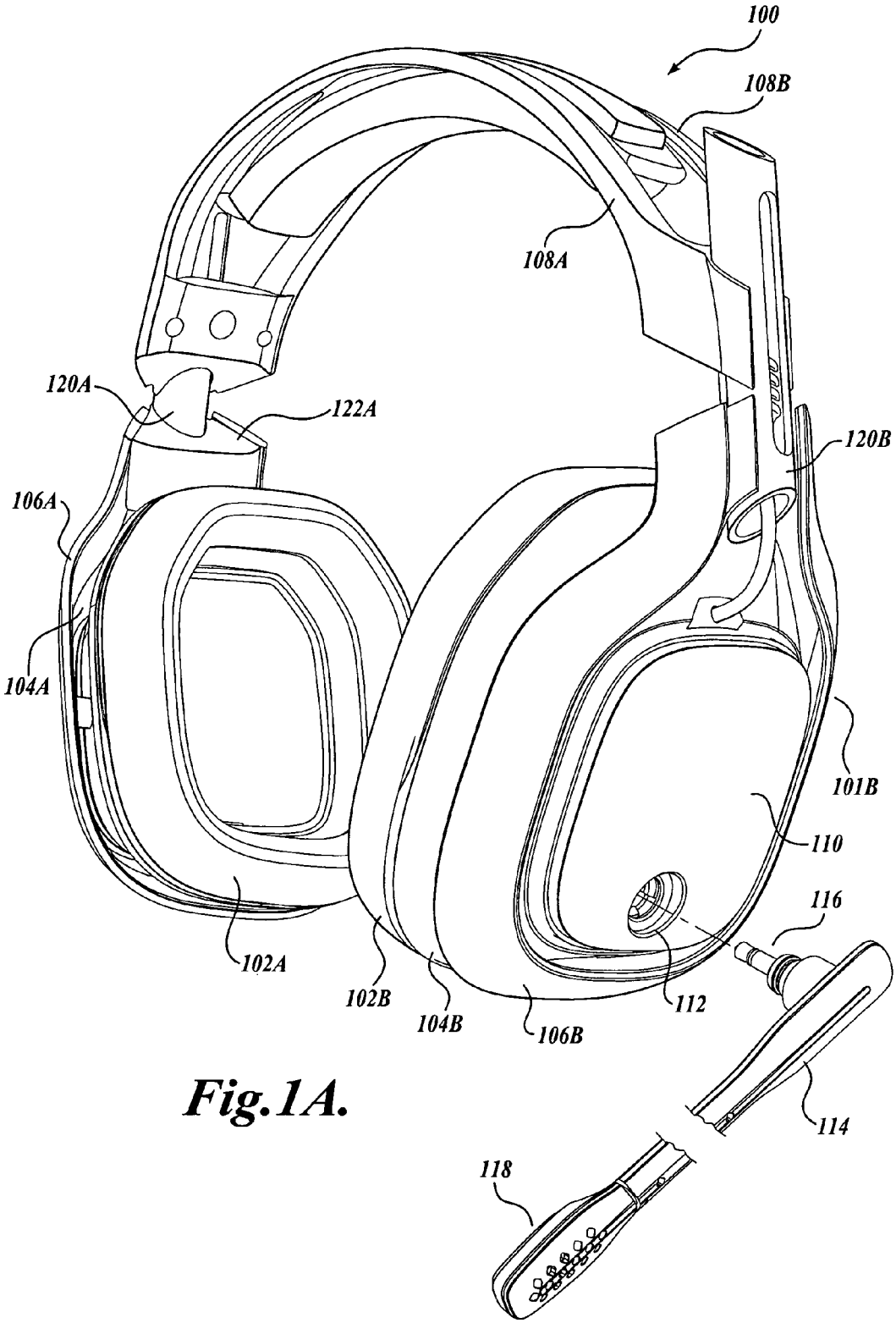
FIG. 1A is a perspective diagram illustrating an exemplary pair of earphones including an exemplary removable boom assembly.
Figure 1B:
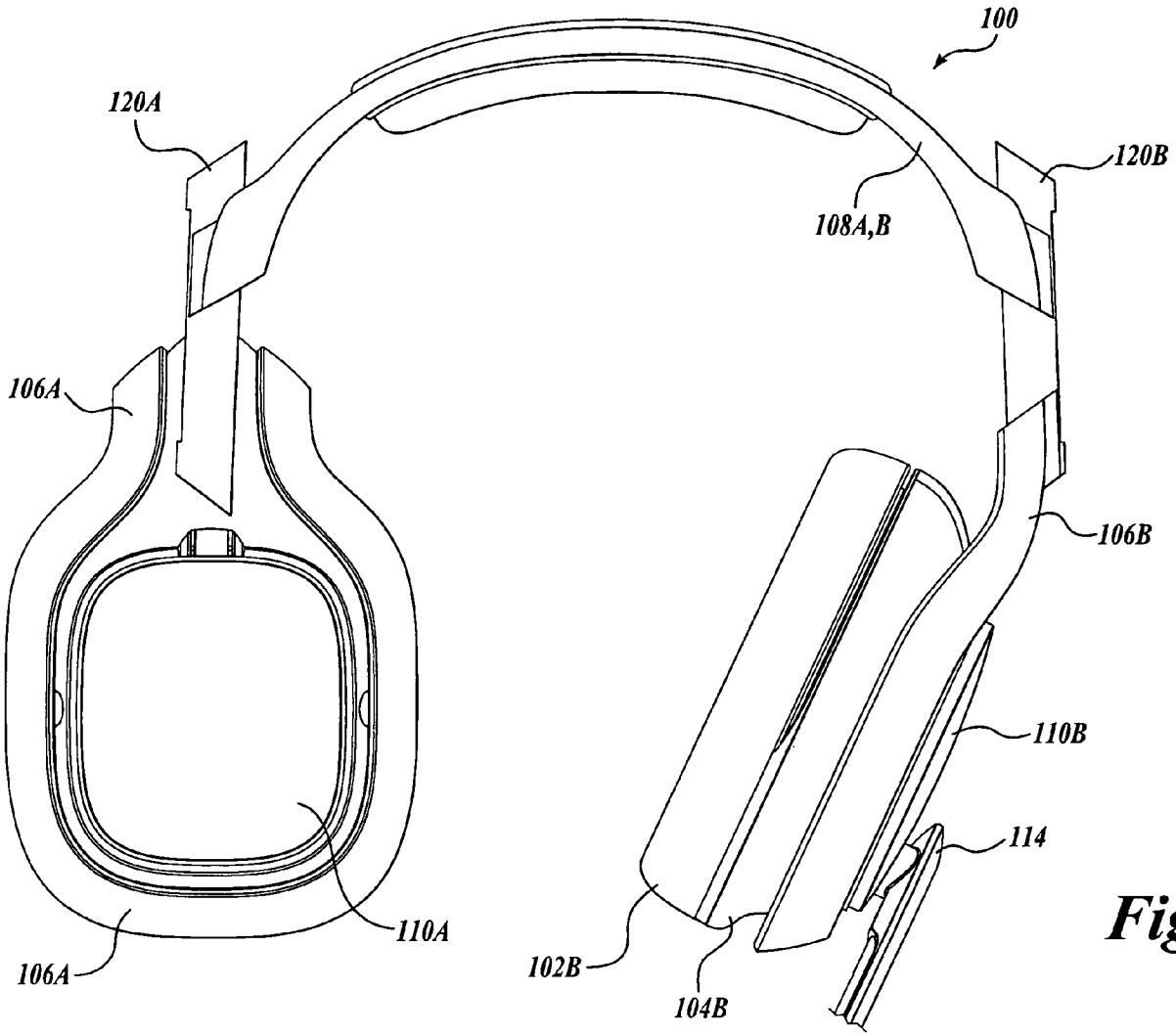
FIG. 1B is a perspective diagram illustrating an exemplary pair of earphones including an exemplary removable boom assembly.

FIGS. 1A, 1B illustrate a headset 100 that comprises a pair of earphones 101*a*, 101*b* held over a gamer's ears by a pair of bands 108*a*, 108*b* worn over the head. Each earphone 101*a*, 101*b* includes a pad 102*a*, 102*b*, which envelops the ear by enclosing it completely. Each earphone 101*a*, 101*b* includes a frame 106*a*, 106*b* that is mechanically coupled to a shell 102*a*, 102*b*. The shell 102*a*, 102*b* is further mechanically coupled to the pad 102*a*, 102*b* to enclose assembled parts residing between the pad 102*a*, 102*b* and the shell 104*a*, 104*b*, as well as providing rigidity to the structure of each earphone 101*a*, 101*b*.

Each earphone 101*a*, 101*b* includes a noise plate 110 to provide insulation against distracting noise that is produced in a competitive environment, such as during gaming tournaments. The noise plate 110 can be removed by exerting a force greater than the magnetic coupling that fastens the noise plate 110 to the earphone 101*a*, 101*b* so as to allow the wearer of the headset 100 to hear teammates shouting out during tournaments. The noise plate 110 includes an aperture 112 that guides a jack 116 of a boom assembly 114 to mate with a female port (not shown) of the earphone 101*a*, 101*b*. When connected, the wearer of the headset 100 may audibly communicate via utterances that are received by the microphone screen 118 for transmission to audio circuitry components (not shown).

The earphones 101*a*, 101*b* are mechanically coupled to the band 108*a*, 108*b* via hollowed cylinders 120*a*, 120*b*. Protected by these cylinders 120*a*, 120*b* are audio wires that transmit audio communication to the earphones 101*a*, 101*b*. These audio wires also receive audio communication received from the boom assembly 114 for transmission to other audio processing circuitry (not shown). FIG. 1B illustrates that the earphone 101*a* can be rotated about 90 degrees. The earphone 101*b* can be similarly rotated. When the wearer of the headset 100 rests the headset 100 on his neck, both earphones 101*a*, 101*b* may be rotated so that the pads 102*a*, 102*b* engage his chest, and in this manner, add comfort as well as exposing art work, advertisements, insignia, trademarks, designs, etc., on the noise plates 110*a*, 110*b*.

Figure 2:
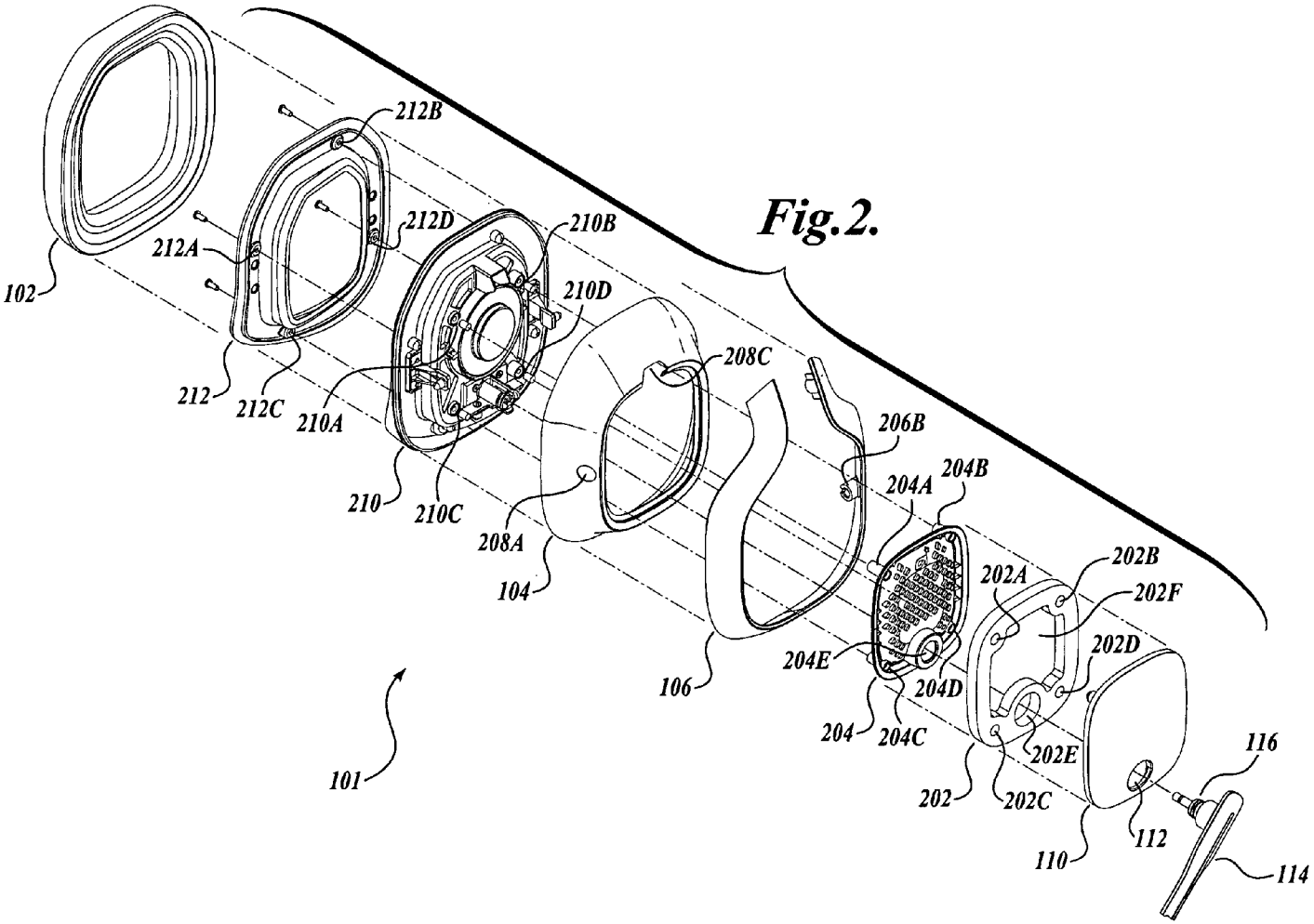
FIG. 2 is an exploded perspective diagram of an exemplary earphone.
Figure 3:
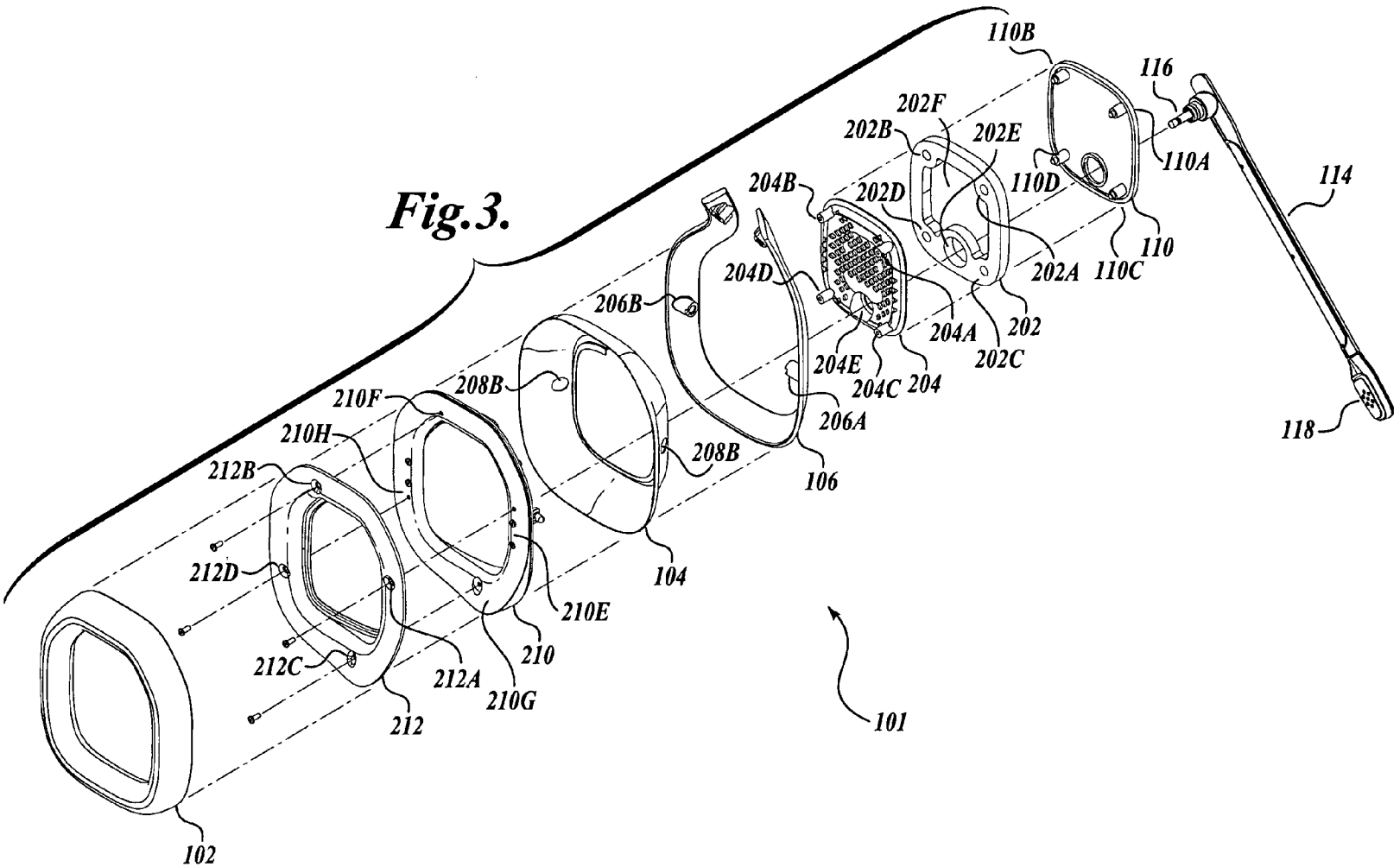
FIG. 3 is an exploded perspective view of an exemplary earphone.

FIGS. 2-3 illustrate an exemplary earphone 101 presented in an exploded perspective view. The earphone 101 includes the noise plate 110. The noise plate 110 is rectangular in shape and includes an aperture 112 for guiding jack 116 to audio circuitry (not shown) to transmit audio information received by the boom assembly 114. The earphone 101 includes a gasket 202 having an annular shape for defining an opening 202*f*. Multiple holes 202*a*-202*d* are provided near the corners of the gasket 202. These holes allow magnetic members 210*a*-210*d* to magnetically couple the noise plate 110 to other assembled parts of the earphone 101. The gasket 202 includes an aperture 202*e* to cooperatively communicate with the aperture 112 for guiding jack 116 to mate with audio circuitry (not shown) of the earphone 101. In one embodiment, the gasket 202 suitably is formed from materials that help the noise plate 110 to cancel or reduce noise. One suitable material includes foam.

The earphone 101 includes a grille 204 that is characterized by perforation forming a screen through which ambient sound may enter the earphone 101 if such ambient sound were not to be attenuated or eliminated by the noise plate 110 or the gasket 202, each alone or in combination. The grille 204 includes a number of hollowed cylinders 204*a*-204*d* for accommodating a number of magnetic members 210*a*-210*d* to magnetically couple an assembly of the noise plate 110, the gasket 202, and the grille 204 to the remaining assembled parts of the earphone 101. A hollowed, projected cylinder 204*e* protrudes into the aperture 202*e* of the gasket 202 which terminates at the aperture 112 of the noise plate 110 to further help guide the jack 116 of the boom assembly 114 to mate with audio circuitry (not shown) of the earphone 101.

The earphone 101 includes a frame 106 characterized by its U-shaped racetrack form. Protruding at an angle from one side of either arm of the U-shaped frame 106 is a hollowed cylinder 206*a*, 206*b* that engages openings 208*a*, 208*b* of the earphone 101 to allow the frame 106 to cradle at various angles, hence adding comfort to the wearer of the earphone 101.

The earphone 101 includes the shell 104 having two open ends. The diameter of a proximal end of the shell 104 tapers gradually to a distal end of the shell 104 to form a neck. Two openings 208*a*, 208*b* on either side of the neck of the shell 104 mate with projected hollowed cylinders 206*a*, 206*b* of the frame 106, thus allowing the frame 106 to cradle against the shell 104. A notch 208*c* located at the distal end of the shell 104 is configured to receive speaker wire for transmitting audio information into the earphone 101.

The earphone 101 includes a bezel 210 on which electrical, electronic, and mechanical parts of a speaker system are assembled. The earphone 101 includes a pliant, annular member 212, whose center opening permits audio sound reproduced by the speaker system housed by the bezel 210 to be projected. Multiple holes 212*a*-212*d* couple the annular member 212 to the bezel 210. The pad 102 is a component of the earphone 101 that envelops the ear of the wearer of the earphone 101.

FIG. 3 reveals elements not readily visible with the illustration in FIG. 2. The noise plate 110 of the earphone 101 includes multiple projected, hollowed cylinders 110*a*-110*c* to accommodate magnetic members 210*a*-210*d* to magnetically couple the noise plate 110 to other assembled parts of the earphone 101. The boom assembly 114 includes a proximal end that houses jack 116 and a distal end for accommodating a microphone screen 118. The projected, hollowed cylinders 206*a*, 206*b* are more clearly illustrated by the exploded, perspective view of the earphone 101 presented from the back as shown in FIG. 3.

Figure 4:
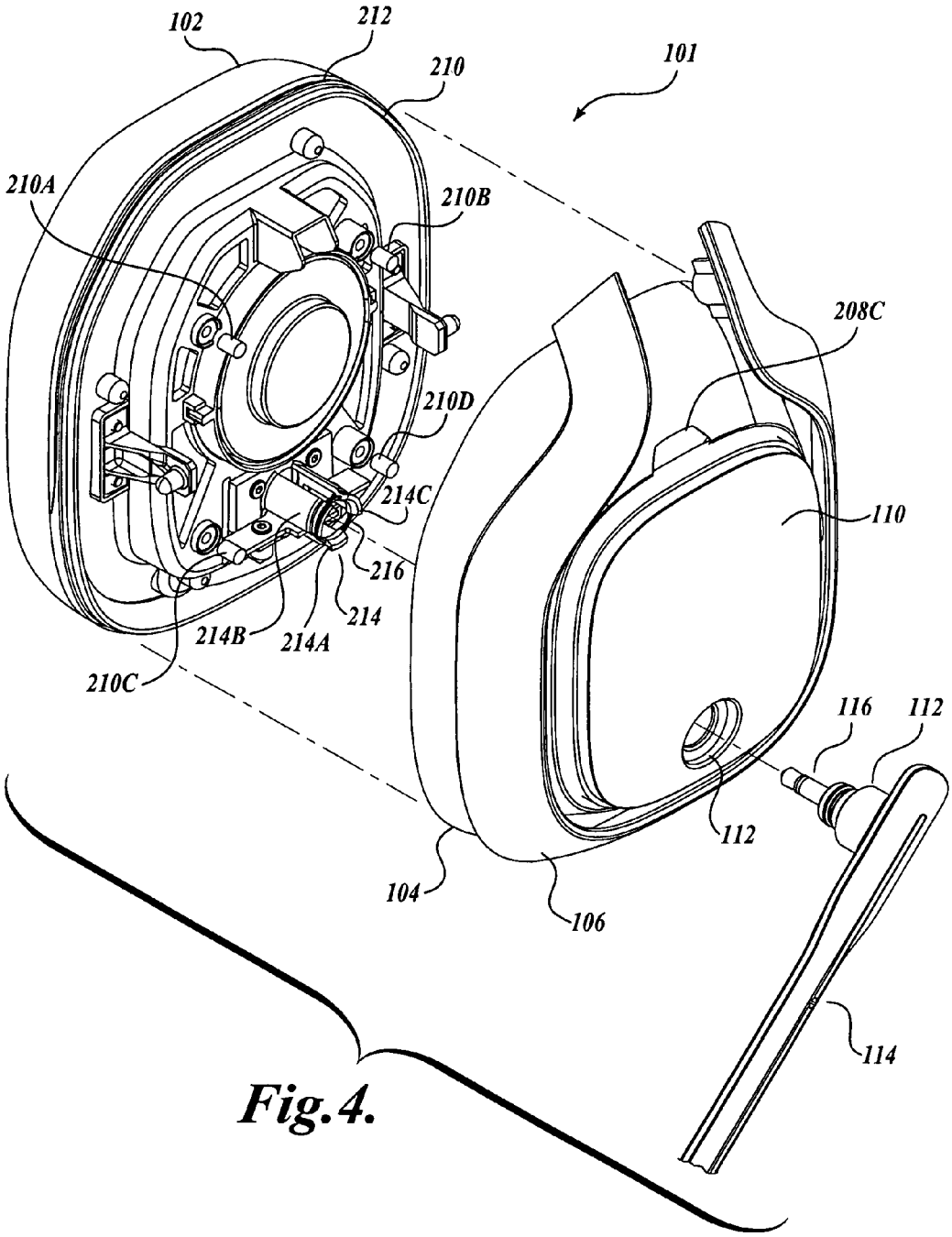
FIG. 4 is an exploded perspective view of a earphone including an exemplary removable boom assembly.

FIG. 4 illustrates a partial assembly of two portions of the earphone 101 in an exploded, perspective presentation. One portion is a fitting of manufactured parts of the earphone 101 that includes an assembly comprising the shell 104, the frame 106, and the noise plate 110. The notch 208*c* into which earphone wires are guided to assembled parts of the earphone 101 is visible. The aperture 112 of the noise plate 110 guides the jack 116 of the boom assembly 114 to mechanically and electrically communicate with a clutch 214, which belongs to the other portion of the earphone 101.

The clutch 214 is housed by the bezel 210. The bezel 210 is one part in an assembly of parts, including the pad 102 and the annular member 212, which together comprise another fitting of manufactured parts of the earphone 101. Specifically, the clutch 214 comprises three fingers 214*a*-214*c* that grip a jack collar 402 to seize the boom assembly 114 firmly while allowing the jack 116 to be in electrical communication with the wire form 216 and other assembled parts of the bezel 210 as well as allowing the boom assembly 114 to be coaxially rotated (in the direction where the jack 116 is inserted into the clutch 214). Multiple magnetic members 210*a*-210*d* are shown floating in the illustration to illustrate its fastening function to magnetically couple the bezel 210 to the other parts of the earphone 101.

Figure 5:
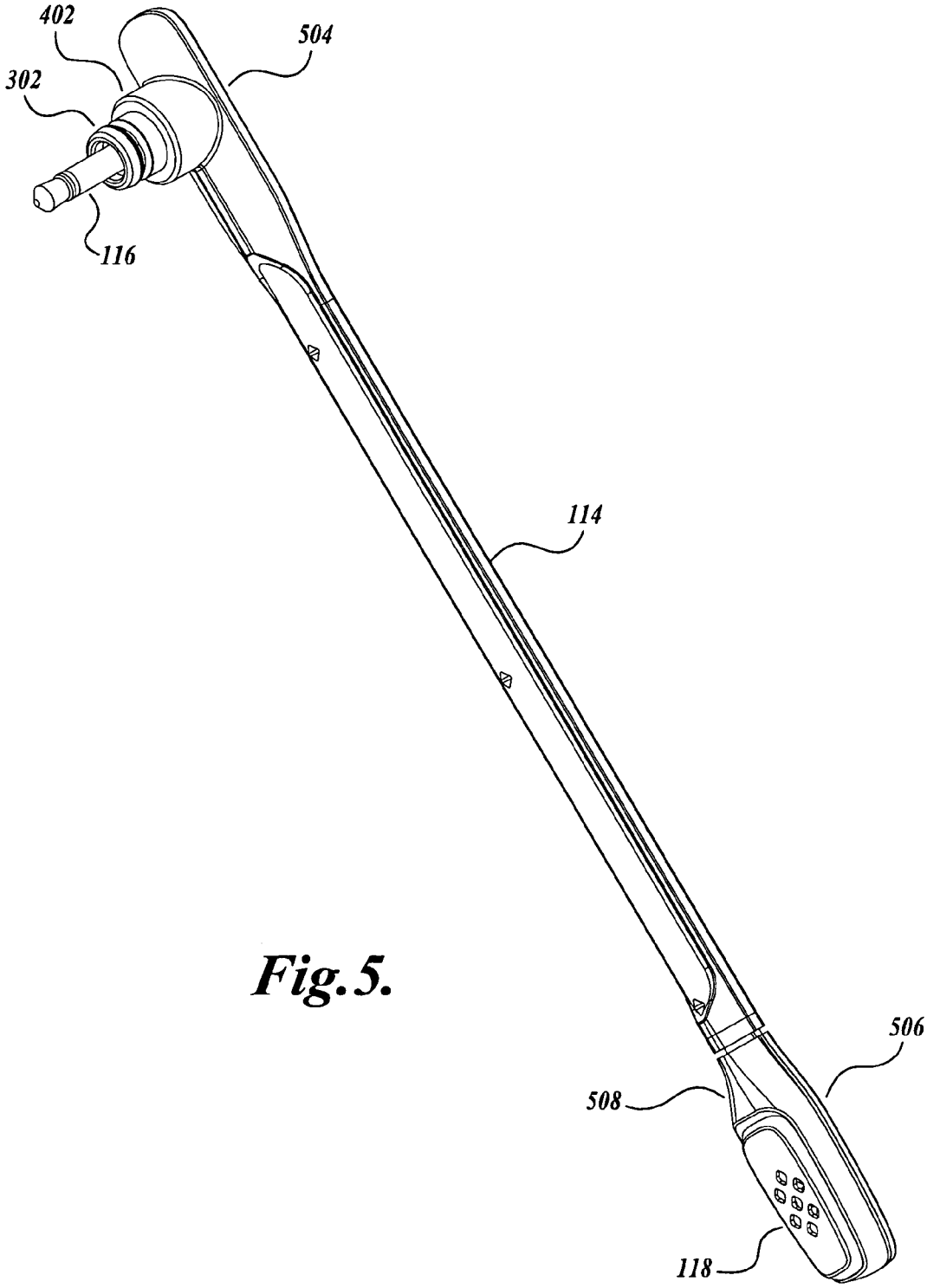
FIG. 5 is a perspective view of a microphone.

FIG. 5 illustrates the boom assembly 114 using a perspective view. The boom assembly 114 includes a boom overmold 504 at a proximal end to house the jack collar 402 that is used to house the jack 116 at its base 502. At the distal end of the boom assembly 114, a microphone receiver is hidden behind the microphone screen 118, which is longitudinally aligned with the front microphone housing 508. Supporting the front microphone housing 508 and the microphone screen 118 is a back 506 of the microphone housing.

Figure 6:
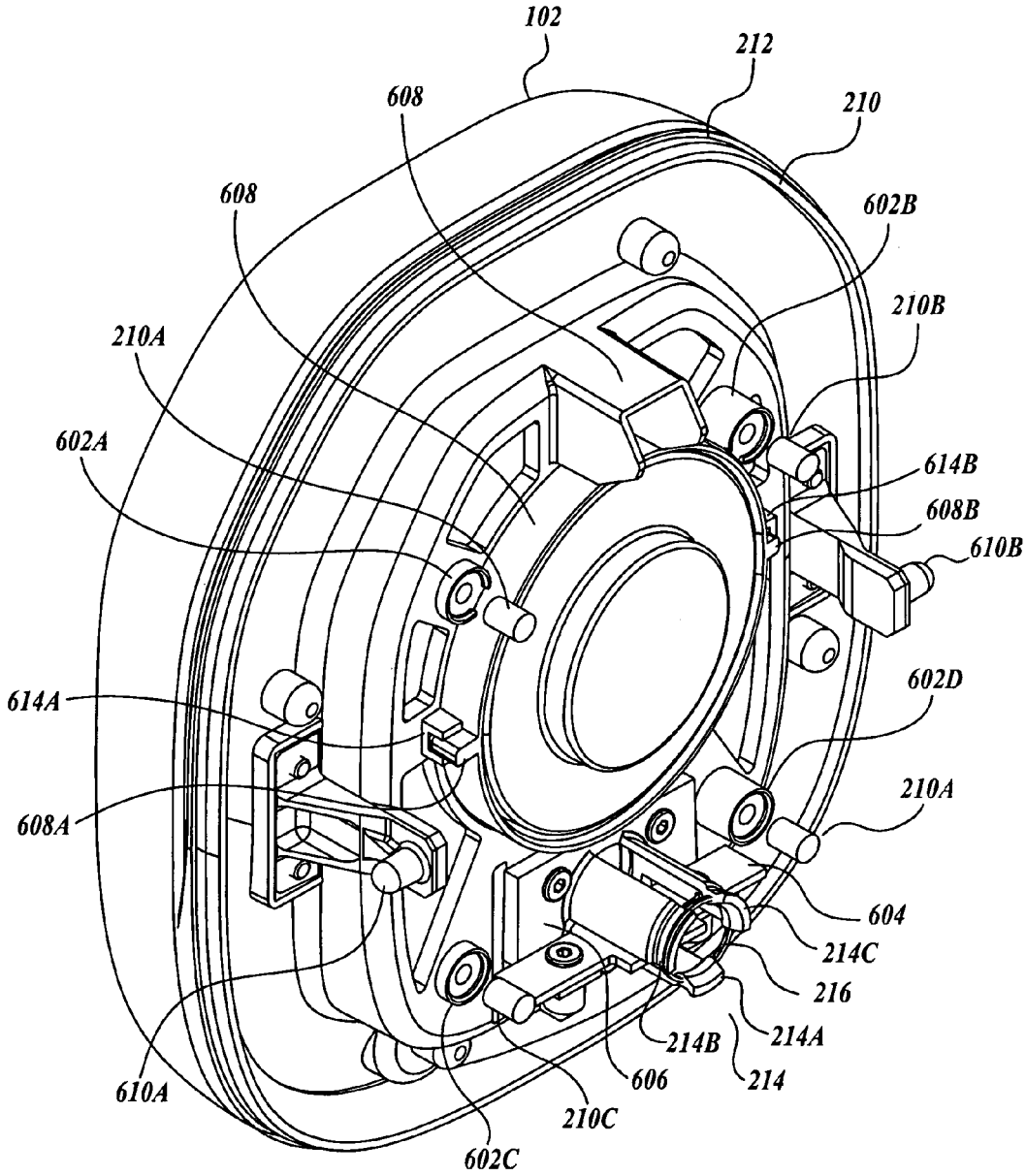
FIG. 6 is a perspective view of an exemplary collection of parts assembled on a bezel so as to change electrical signals into sounds loud enough to be heard by the wearer of an earphone.

FIG. 6 illustrates a collection of parts so assembled to form a portion of the earphone 101. The collection of parts includes the pad 102, the annular member 212, and the bezel 210. The multiple magnetic members 210*a*-210*d* mate with metallic female members 602*a*-602*d* that are characterized as projected, hollowed cylinders, and whose ends include metallic exposures to correspondingly mate with the multiple magnetic members 210*a*-210*d*. The bezel 210 includes the clutch 214, which is formed from three fingers 214*a*-214*c*, perpendicularly projected from a rectangular platform 606 and fastened to the bezel 210 via screws. Wound around the distal ends of the fingers 214*a*-214*c* is a wire form 216 that is configured to mechanically couple with the jack 116 of the boom assembly 114 by providing tension to retain the jack 116. Each finger 214*a*-214*c*, at the distal end, has a groove into which the wire form 216 is set so as to prevent slippage of the wire form 216 from the fingers 214*a*-214*c*. A PC board 604 containing audio circuitry lies on the finger 214*a* and superjacent to the PC board 604 are the fingers 214*b*, 214*c*.

The bezel 210 includes a driver protector 608 that is characterized by its annular shape including two wings 608*a*, 608*b*. The driver protector 608 is fastened to the bezel 210 using a suitable fastening agent, such as glue. The wings of the driver protector 608 mate with two C-shaped members 614*a*-614*b* to prevent slippage of the driver protector 608. Two fingers 610*a*-610*b*, preferably formed from aluminum, are mounted to the bezel 210 at a proximal end while their distal ends are finished with dome-like members that are projected away from each other to mate with holes 208*a*, 208*b*, allowing the frame 106 to cradle against the shell 104, as previously discussed in other figures, such as FIG. 2.

Figure 7A:
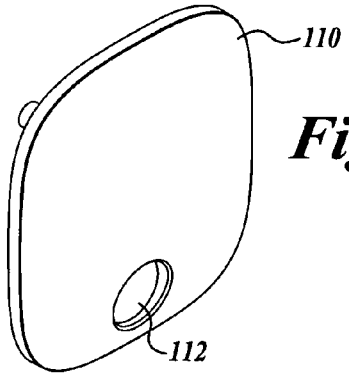
FIG. 7A illustrates an external perspective view of an exemplary noise plate.
Figure 7B:
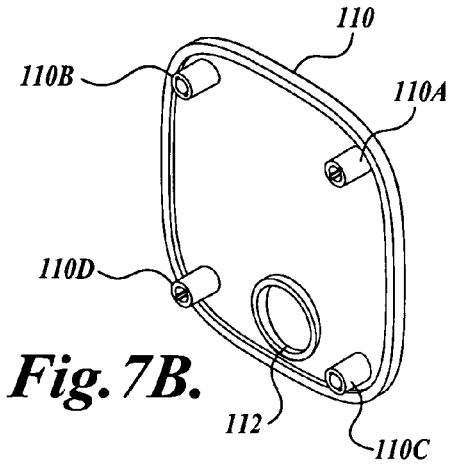
FIG. 7B illustrates an internal perspective view of an exemplary noise plate.
Figure 7C:
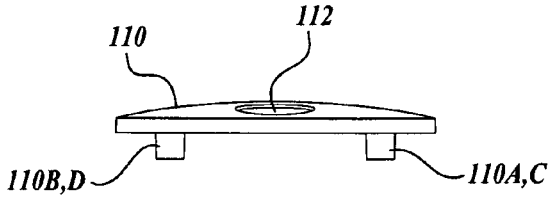
FIG. 7C illustrates a bottom view of an exemplary noise plate.
Figure 7D:
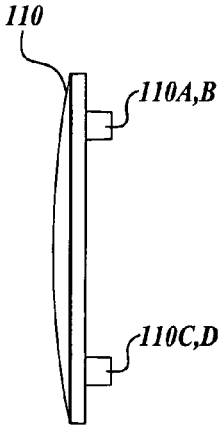
FIG. 7D illustrates a side view of an exemplary noise plate.
Figure 7E:
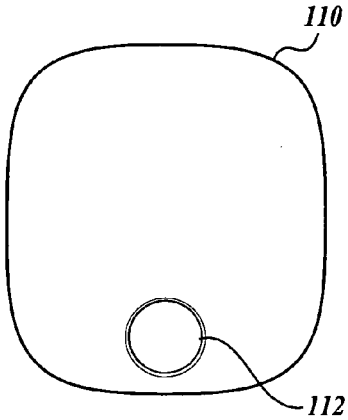
FIG. 7E illustrates a front view of an exemplary noise plate.
Figure 7F:
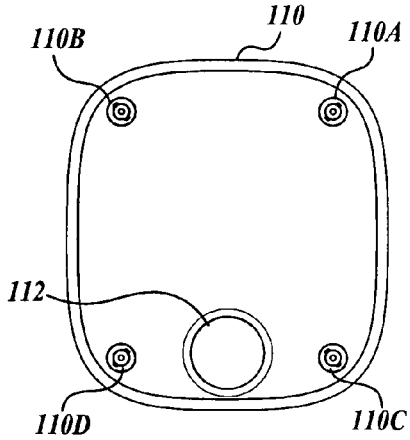
FIG. 7F illustrates a back view of an exemplary noise plate.
Figure 7G:
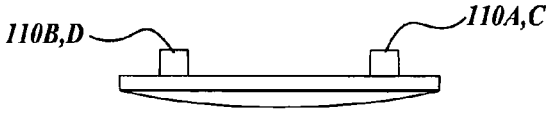
FIG. 7G illustrates a top view of an exemplary noise plate.

FIGS. 7A-7G illustrate various views of the noise plate 110. FIG. 7A illustrates a perspective view from the front of the noise plate 110 including a partial view of the projected, hollowed cylinder 110*a*. FIG. 7B illustrates a perspective view from the back of the noise plate 110. FIG. 7C illustrates a bottom view of the noise plate 110 in which a slight curvature can be observed across the surface of the noise plate 110. FIG. 7D illustrates a side view of the noise plate 110 in which a slight curvature can be observed. FIG. 7E is a front view of the noise plate 110. FIG. 7F is a back view of the noise plate 110. FIG. 7G is a top view of the noise plate 110, whose curvature is seen across the surface.

While illustrative embodiments have been illustrated and described, it will be appreciated that various changes can be made therein without departing from the spirit and scope of the invention.

The embodiments of the invention in which an exclusive property or privilege is claimed are defined as follows:

1. A headset comprising:

a left earphone configured to convert electrical energy into sound waves, the left earphone including a left noise plate, the left noise plate including a left aperture configured to guide a microphone to make contact with the left earphone;

a right earphone configured to convert electrical energy into sound waves, the right earphone including a right noise plate, the right noise plate including a right aperture configured to guide the microphone to make contact with the right earphone;

a band configured to hold the left earphone and the right earphone so as to allow the headset to be worn over the head of a wearer;

each of the left and right earphones including a frame that is characterized by a U-shaped racetrack form, hollowed cylinders protruding at an angle from one side of either arm of the U-shaped frame to allow the frame to cradle; and each of the left and right earphones further including a shell having two open ends, one open end being a proximal end and the other open end being a distal end, a diameter of the proximal end of the shell tapering gradually to the distal end of the shell to form a neck, two openings on either side of the neck of the shell mating with projected hollowed cylinders of the frame.

2. The headset of claim 1, further comprising a left cylinder and a right cylinder that mechanically couple the band to the left earphone and the right earphone, the left earphone being configured so as to allow the left earphone to turn ninety degrees around the left cylinder, the right earphone being configured so as to allow the right earphone to turn ninety degrees around the right cylinder.

3. The headset of claim 1, further comprising a boom assembly that is characterized by its longitudinal shape having a proximal end and a distal end, the proximal end supporting a jack collar that houses a jack configured to insert into either the left aperture of the left noise plate of the left earphone or the right aperture of the right noise plate of the right earphone, the distal end supporting a microphone screen configured to receive utterances of the wearer of the headset.

4. The headset of claim 1, wherein either the left noise plate or the right noise plate is removable by exerting a force greater than a magnetic coupling that fastens either the left noise plate to the left earphone or the right noise plate to the right earphone.

5. The headset of claim 4, wherein four hollowed cylinders are projected from the back of either the left noise plate or the right noise plate, each hollowed cylinder being configured to house a magnetic member to couple either left noise plate to the left earphone or the right noise plate to the right earphone.

6. The headset of claim 5, further comprising a gasket that is characterized by an annular shape configured to define an opening and multiple holes near the corners of the gasket, each hole facilitating a magnetic member to reach a hollowed cylinder of either the left noise plate or the right noise plate, the gasket including an aperture that is configured to cooperatively communicate with the aperture of either the left noise plate or the right noise plate for guiding the jack to mate with audio circuitry.

7. The headset of claim 6, further comprising a grille configured to form a screen whose perforation allows ambient sound to enter either the left earphone or the right earphone if such ambient sound is not attenuated or eliminated by either the left noise plate or the right noise plate, the gasket, alone or in combination, and the grille including a number of hollowed cylinders configured to facilitate magnetic members to magnetically couple the noise plate, the gasket, and the grille into an assembly of parts.

8. The headset of claim 1, further comprising a bezel on which electrical, electronic, and mechanical parts of a speaker system are assembled.

9. The headset of claim 8, further comprising a pliant, annular member, whose center opening permits audio sound reproduced by the speaker system housed by the bezel to be projected.

10. The headset of claim 9, further comprising a pad that is configured to envelope an ear of the wearer of the headset.

11. An earphone comprising:

an assembly of parts configured to convert electrical energy into sound waves, the assembly including a noise plate, the noise plate including an aperture configured to guide a microphone to make contact with the earphone;

a frame that is characterized by a U-shaped racetrack form, hollowed cylinders protruding at an angle from one side of either aim of the U-shaped frame to allow the frame to cradle; and a shell having two open ends, one open end being a proximal end and the other open end being a distal end, a diameter of the proximal end of the shell tapering gradually to the distal end of the shell to form a neck, two openings on either side of the neck of the shell mating with projected hollowed cylinders of the frame.

12. The earphone of claim 11, wherein the noise plate is removable by exerting a force greater than a magnetic coupling that fastens the noise plate to the assembly of parts.

13. The earphone of claim 12, wherein four hollowed cylinders are projected from the back of the noise plate, each hollowed cylinder being configured to house a magnetic member to couple to the noise plate.

14. The earphone of claim 13, further comprising a gasket that is characterized by an annular shape configured to define an opening and multiple holes near the corners of the gasket, each hole facilitating a magnetic member to reach a hollowed cylinder of the noise plate, the gasket including an aperture that is configured to cooperatively communicate with the aperture of the noise plate for guiding a microphone jack to mate with audio circuitry.

15. The earphone of claim 14, further comprising a grille configured to form a screen whose perforation allows ambient sound to enter the earphone if such ambient sound is not attenuated or eliminated by the noise plate, the gasket, alone or in combination, and the grille including a number of hollowed cylinders configured to facilitate magnetic members to magnetically couple the noise plate, the gasket, and the grille into an assembly of parts.

16. The earphone of claim 11, further comprising a bezel on which electrical, electronic, and mechanical parts of a speaker system are assembled.

* * * * *